United States Patent [19]

Martinez

[11] Patent Number: 4,886,206

[45] Date of Patent: Dec. 12, 1989

[54] DISPOSABLE CONTAINER WITH FOLDABLE SPOUT

[76] Inventor: Beatrice E. Martinez, 1401 Middlebury Dr., Alexandria, Va. 22307

[21] Appl. No.: 217,410

[22] Filed: Jul. 11, 1988

[51] Int. Cl.[4] ..... B65D 5/74

[52] U.S. Cl. ..... 229/123.1; 229/1.5 B; 229/125.04

[58] Field of Search ..... 229/123.1, 123.2, 1.5 B, 229/4.5, 125.42; 206/633, 631.2, 631.1, 631, 613, 607; 222/572, 530, 527

[56] References Cited

U.S. PATENT DOCUMENTS

| | | | |
|---|---|---|---|
| 2,546,052 | 3/1951 | Wilkins | 229/125.42 |
| 2,772,823 | 12/1956 | Plamann . | |
| 2,812,126 | 11/1957 | Graybill | 206/631.2 |
| 2,812,127 | 11/1957 | Graybill | 206/631.2 |
| 2,839,234 | 6/1958 | O'Neil . | |
| 3,269,644 | 8/1966 | Bump . | |
| 3,301,458 | 1/1967 | Rausing et al. . | |
| 3,302,858 | 2/1967 | Miller | 229/123.1 |
| 3,421,680 | 1/1969 | Cohee . | |
| 3,488,201 | 1/1970 | Pizarro | 229/123.1 |
| 3,995,806 | 12/1976 | McSherry | 206/631.2 |
| 4,166,566 | 9/1979 | Hamilton . | |
| 4,312,450 | 1/1982 | Reil . | |
| 4,605,142 | 8/1986 | Itoh et al. | 229/123.1 |
| 4,767,035 | 8/1988 | Jacobi | 222/527 |
| 4,799,619 | 1/1989 | Lee | 229/125.42 |

FOREIGN PATENT DOCUMENTS

| | | | |
|---|---|---|---|
| 613023 | 1/1961 | Canada | 206/633 |
| 3446093 | 6/1986 | Fed. Rep. of Germany | 206/633 |
| 1488333 | 6/1967 | France | 206/633 |

*Primary Examiner*—Jimmy G. Foster
*Assistant Examiner*—Jes F. Pascua
*Attorney, Agent, or Firm*—Oliff & Berridge

[57] ABSTRACT

A disposable container for storing and dispensing condiments comprises a cover member, a cup, a foldable spout and a pull-strip which maintains the spout in a folded position during storage. The spout is easily released by the pull-strip, whereupon the foldable spout extends to a pouring position, allowing dispensing of condiments form the container without the spillage associated with conventional condiment containers.

17 Claims, 2 Drawing Sheets

FIG. 3
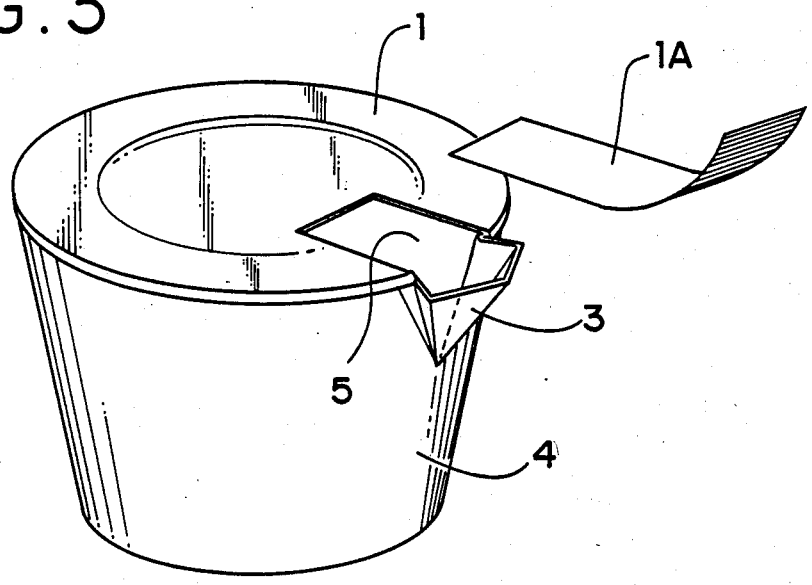
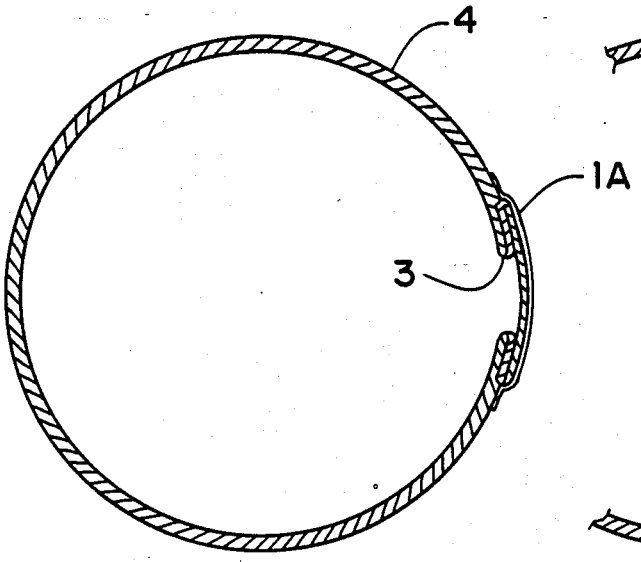
FIG. 4
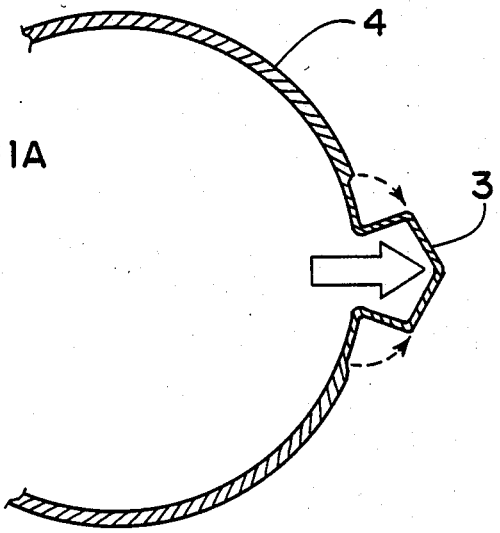
FIG. 5

DISPOSABLE CONTAINER WITH FOLDABLE SPOUT

BACKGROUND OF THE INVENTION

In restaurants everywhere, individual servings of cream, half-and-half, or the like are given patrons for their coffee, tea or other beverage. The containers used to store and dispense such condiments commonly consist of a light-weight corrugated plastic cup covered with a foil lift-up lid and tab. The foil is often covered with a paper printed label identifying the product and distributor/producer thereof.

A problem with known containers used for the above purpose is that, invariably, as the foil tab is lifted, the cream or other condiment spurts out onto the clothing of the patron and his/her surroundings, thus creating a mess.

U.S. Pat. No. 3,421,680 discloses folded box-like cartons and foldable spouts therefor. Such containers would not be easily produced in sizes or shapes appropriate for "single-serving" condiment dispensers. Furthermore, the folded cardboard construction, comprising planar side-wall surfaces, would render the container susceptible to leakage during the rough handling associated with bulk storage and transportation of "single-serving" condiment dispensers.

SUMMARY OF THE INVENTION

An object of the present invention is to obviate the above-described problems with known dispensers. This and other objects are achieved by the provision of a disposable container with a cup including a sidewall member of generally arcuate shape and a foldable spout adjacent an upper edge portion thereof, and a cover member covering the cup. The cover may include a cut-out portion adjacent the foldable spout. A pull-strip is provided which is adapted to overlie the foldable spout and any cut-out portion and be removably secured to the container to seal the container and maintain the foldable spout in a folded position during periods of storage. The pull-strip is easily removable from the spout to allow the foldable spout to expand outwardly to a pouring position.

The container remains substantially closed while the pull-strip is being pulled, thus avoiding the spillage associated with conventional condiment containers. The posibility of spillage is further reduced because the cover remains intact with the cup of the container and the spout structure provides for smooth flow of condiment from the container during pouring.

BRIEF DESCRIPTION OF THE DRAWINGS

FIGS. 1–3 are perspective views of the invention shown in various stages of opening of the foldable spout in a preferred embodiment of the present invention.

FIGS. 4 and 5 are horizontal cross-sectional views taken through the spout of the embodiment of FIG. 1 depicting the spout in a folded position with the pull-strip intact and in an expanded position with the pull-strip removed, respectively.

DETAILED DESCRIPTION OF PREFERRED EMBODIMENTS

Figure 1:
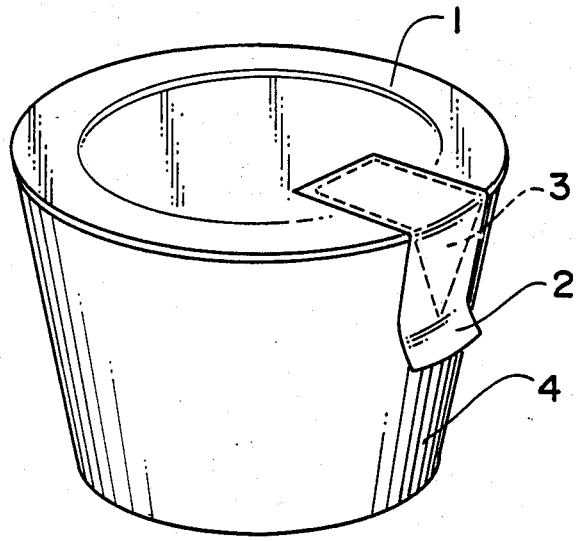

Referring to the drawing figures, a bottomed, cylindrical or frustoconical container comprises cover 1, removeable pull-strip 1A, foldable spout 3 and cup 4. Foldable spout 3 is provided adjacent an upper arcuate edge of the cup 4. A rectangular cut-out portion 5 may be provided in cover 1. Although the present invention is applicable to containers of all sizes, the invention is of particular utility as applied to "single-serving" size condiment containers, e.g., with a capacity of 1 ounce or less.

Foldable spout 3 is comprised of four inverted triangular panels and five fold-lines arranged such that the spout may be folded flush against the arcuate sides of cup 4 and retained in a folded position by pull-strip 1A. As seen in FIGS. 4 and 5, the sidewall of cup 4 may be provided with an area of reduced thickness adjacent spout 3 to accommodate spout 3 flush with the outer surface of the surrounding container wall in a folded position. Spout 3 may also be provided of reduced thickness to facilitate folding and elastic expansion thereof.

Pull-strip 1A is secured to cover 1 and extends over cut-out portion 5 and foldable spout 3 to create a sanitary seal of the container during storage. Pull-strip 1A can be made of suitable material such as foil, plastic and/or paper. Adhesion of pull-strip 1A to the container is effected by known non-toxic releasable adhesive material. Alternatively, non-releasable adhesive material could be used, with lines of weakness provided in the pull-strip to permit, for example, a central portion of the pull strip to be pulled away from the spout while its edges remain adhered to the container wall. The sidewalls of cup 4 may be corrugated to provide extra strength and ease of handling, in which case a non-corrugated area may be provided adjacent spout 3 for adhesion of pull-strip 1A if necessary.

Cup 4 and cover 1 may be formed integrally of suitable material such as a plastic material by known molding techniques, e.g., blow-molding. Alternatively, cup 4 and cover 1 may be formed separately by molding or stamping and later attached by known methods of plastic bonding such as ultrasonic bonding or adhesive bonding. Spout 3 may be molded or stamped integrally with cup 4, or could be formed separately and later attached to cup 4 by known bonding techniques. Of course, the method of assembly used must not involve materials capable of contaminating the contents of the container.

Figure 2:
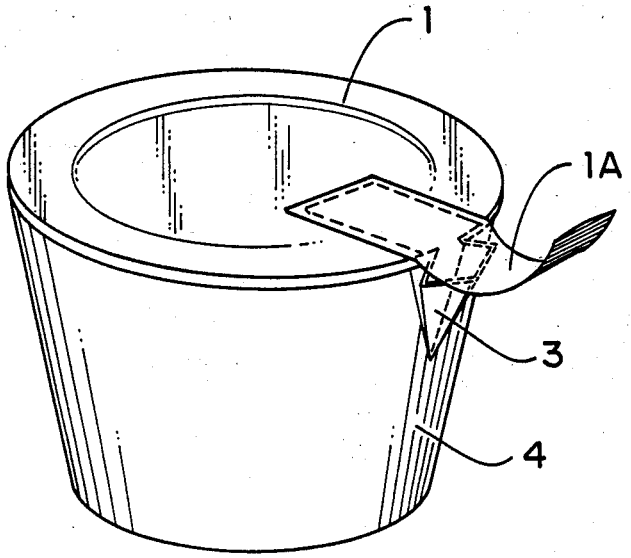

FIGS. 1–3 show progressively the opening of foldable spout 3. In FIG. 1, the container is sealed and foldable spout 3 is held in a folded position by pull-strip 1A. An end portion, or pull-up tag 2, of pull-strip 1A remains loose so as to be easily clenched between two fingers for pulling to open the container. In FIG. 2, pull-strip 1A has been detached from sidewall member 4 and foldable spout 3 has begun to expand. Expansion of foldable spout 3 is for the most part automatic due to the elastic nature of the spout structure. Expansion of spout 3 may be facilitated further by slight squeezing of spout 3 itself. In FIG. 3, pull-strip 1A has been removed entirely whereby cut-out portion 5 and spout 3 are entirely exposed and the container is ready for pouring. Pull-strip 1A need not be removed entirely from the container. Instead, provision, such as by stronger adhesive, may be made to keep an end portion of pull-strip 1A opposite pull-up tag 2 intact with cover 1 during pouring, thus reducing the problems of litter and table clutter during dining.

Having thus described the present invention in terms of preferred embodiments thereof, it is to be understood that certain modifications within the invention will become apparent to those skilled in the art. Accordingly, the invention is limited solely by the scope of the appended claims.

What is claimed is:

1. A disposable container adapted to hold and dispense condiments and the like, comprising:

a cup member with an arcuate sidewall including a foldable spout member adjacent an upper edge portion thereof;

a cover member secured to said upper edge portion; and a pull-strip adapted to overlie said foldable spout member and to be secured to said container to thereby seal said container and maintain the foldable spout in a folded position without leakage during periods of storage, said pull-strip being at least partially releasable from said container, whereupon said foldable spout expands outwardly to a pouring position.

2. A disposable container as recited in claim 1, wherein said cover member comprises a cut-out portion adjacent said foldable spout member, said cut-out portion being sealed by said pull-strip during said periods of storage and exposed upon at least partial removal of the pull-strip.

3. A disposable container as recited in claim 1, wherein said foldable spout is flared outwardly from said sidewall toward said upper edge portion.

4. A disposable container as recited in claim 3, wherein said foldable spout comprises four inverted triangular panel portions foldable along five fold lines situated about a triangular cut-out in said sidewall.

5. A disposable cover as recited in claim 1, wherein said pull-strip is only partially releasable from said container such that an end portion of said pull-strip remains intact with said cover during pouring.

6. A disposable container as recited in claim 1, wherein said arcuate sidewall comprises corrugated plastic material.

7. A disposable container as recited in claim 1, wherein said cover and cup are formed of plastic material, and said pull-strip comprises at least one member selected from the group consisting of foil and paper material.

8. A disposable container as recited in claim 1, wherein said cover and said cup are of integrally molded plastic material.

9. A disposable container as recited in claim 1, wherein said cover is formed apart from said cup and bonded to the upper edge portion of the cup.

10. A disposable container as recited in claim 1, wherein said foldable spout is molded integrally with said arcuate sidewall.

11. A disposable container as recited in claim 1, wherein said container has a storage capacity of 1 ounce or less.

12. A disposable container as recited in claim 1, wherein said cover and cup are formed of the same material.

13. A disposable container as recited in claim 12, wherein said material is plastic.

14. A disposable container adapted to hold and dispense condiments and the like, comprising:

a cup member with an arcuate sidewall including a foldable spout member adjacent an upper edge portion thereof;

a cover member secured to said upper edge portion;

a pull strip adapted to overlie said foldable spout member and to be secured to said container to thereby seal said container and maintain the foldable spout in a folded position without leakage during periods of storage, said pull-strip being at least partially releasable from said container, whereupon said foldable spout expands outwardly to a pouring position;

said foldable spout and an area of said sidewall adjacent said spout are provided with a reduced thickness.

15. A disposable container as recited in claim 14, wherein said foldable spout is flared outwardly from said sidewall toward said upper edge portion.

16. A disposable container as recited in claim 14, wherein said foldable spout comprises four inverted triangular panel portions foldable along five fold lines situated about a triangular cut-out in said sidewall.

17. A disposable container as recited in claim 14, wherein said reduced thickness area of said sidewall accommodates said foldable spout therein flush with adjacent portions of said sidewall when said spout is in said folded position.

* * * * *